US007497332B1

(12) United States Patent
Schwimmer

(10) Patent No.: US 7,497,332 B1
(45) **Date of Patent: *Mar. 3, 2009**

(54) POLYGON-SHAPED, KNOCKDOWN, AND STACKABLE CONTAINER

(76) Inventor: Chaim Schwimmer, 5411 14th Ave., Brooklyn, NY (US) 11219

( * ) Notice: Subject to any disclaimer, the term of this patent is extended or adjusted under 35 U.S.C. 154(b) by 410 days.

This patent is subject to a terminal disclaimer.

(21) Appl. No.: 11/418,912

(22) Filed: May 5, 2006

(51) Int. Cl.
*B65D 19/00* (2006.01)
*B65D 6/14* (2006.01)

(52) U.S. Cl. ..... 206/600; 229/122.21; 220/4.33; 220/62.2

(58) Field of Classification Search ..... 206/524.2, 206/600; 220/4.33, 62.2; 229/122.21, 108, 229/199.1, 109, 122.32, 122.33; 217/12 R, 217/12 A, 13, 43 R, 45, 17, 43 A
See application file for complete search history.

(56) References Cited

U.S. PATENT DOCUMENTS

| | | | | |
|---|---|---|---|---|
| 641,207 | A | 1/1900 | Higham | |
| 1,821,307 | A | 9/1931 | Howland | |
| 2,003,326 | A | 6/1935 | Wellman | 229/23 |
| 2,019,787 | A | 11/1935 | Leopold | 229/41 |
| 2,132,666 | A | 10/1938 | Williams | 229/43 |
| 2,775,393 | A | 12/1956 | Rugg | 229/41 |
| 2,778,523 | A * | 1/1957 | Dedmon | 217/43 R |
| 3,342,364 | A | 9/1967 | Bingham et al. | 217/69 |
| 3,405,835 | A * | 10/1968 | Eby | 220/4.34 |
| 3,559,938 | A * | 2/1971 | Harris | 248/188 |
| 3,937,392 | A | 2/1976 | Swisher | |
| 4,314,602 | A | 2/1982 | Frederick et al. | 165/10 |
| 4,635,815 | A | 1/1987 | Grigsby | |
| 4,673,087 | A | 6/1987 | Webb | |
| 4,828,132 | A | 5/1989 | Francis, Jr. et al. | |
| 5,279,436 | A | 1/1994 | Elliott et al. | 220/1.5 |
| 5,351,846 | A | 10/1994 | Carter | 220/6 |
| 5,377,857 | A | 1/1995 | Taravella et al. | |
| 5,415,310 | A | 5/1995 | Simms | 220/4.28 |
| 5,690,274 | A | 11/1997 | Yang | |
| 5,743,422 | A | 4/1998 | Hale | |
| 6,145,924 | A * | 11/2000 | Mero et al. | 297/68 |
| 6,241,148 | B1 * | 6/2001 | Schwimmer | 229/122.21 |
| 6,415,927 | B1 * | 7/2002 | Stone et al. | 206/600 |

* cited by examiner

*Primary Examiner*—Jila M Mohandesi
*Assistant Examiner*—Sharon M Prange
(74) *Attorney, Agent, or Firm*—Bernard S. Hoffman

(57) ABSTRACT

A polygon-shaped, knockdown, and stackable container. The container includes a side wall having a plurality of panels. The plurality of panels include a pair of skins and a plurality of cores. The plurality of cores are sandwiched between the pair of skins to form a laminate. The core has an axial compression strength greater than that of the pair of skins to allow the core to prevent puncturing, to provide insulation, to prevent any deformation or collapse during stacking, to avoid warping, and to resist against bulging as a result of internal material flow, while the pair of skins reduce overall weight.

22 Claims, 3 Drawing Sheets

POLYGON-SHAPED, KNOCKDOWN, AND STACKABLE CONTAINER

1. CROSS REFERENCE TO RELATED APPLICATIONS

The polygon-shaped, knockdown, and stackable container taught by the instant application is an improvement over the polygon-shaped container taught by my U.S. Pat. No. 6,241,148 to Schwimmer, which is incorporated herein by reference thereto.

2. BACKGROUND OF THE INVENTION

A. Field of the Invention

The present invention relates to a container, and more particularly, the present invention relates to polygon-shaped, knockdown, and stackable container.

B. Description of the Prior Art

Gaylord containers have been known and used for years to ship large quantities of material, 1,000 pounds or more. The Gaylord containers in the past have been made from corrugated paperboard or cardboard. Corrugated cardboard containers are relatively weak and can be easily punched through by sharp objects.

For the heavy duty packaging, transportation and shipment of dry flow materials, such as granular or powdered products, the choice of commercial containers lies between multi-wall bags and drums, since other forms, such as boxes, etc., are unsuitable, being unduly cumbersome to handle and inherently ill adapted to a sift proof construction.

Bags are quantity produced in a flat state and are shipped and stored as such, but are restricted to packaged bulks of about 50 to 100 pounds, by reason of structural limitations and lifting weights, and also require special equipment for filling, such as valve bag filling machines for valve bags, or for closing after filling, such as special field closure and sealing units for closing open ended bags, both requiring trained operators.

Drum containers are inherently stronger than multi-wall bags and can handle heavier bulk loads up to about 300-400 pounds with facility in that they can be rolled about without lifting and easily upended for emptying. They also inherently possess an open ended utility for filling, as from a gravity fed storage container, and for emptying, as by way of a suction line.

Containers made of corrugated paperboard have long been used for shipping and storing a variety of bulk materials, such as powders, tobacco, metal castings, plastic resins, peanuts, and many other materials. These bulk materials are typically poured or thrown into the container and shipped loose so that the packed materials "flow" about the interior of the container.

Since the total weight of a single loaded container may run as high as 1500 pounds, the packing and shipping of bulk materials presents several unique problems. One problem is that the side walls of the container must be sufficiently rigid in the horizontal plane to withstand internal movement of the load. Stated in the parlance of the trade, the side walls must resist against bulging as a result of internal material flow.

Another problem is that the side walls of the container must also be sufficiently rigid to permit stacking of one container on top of another. Stated in the parlance of the trade, the side walls must provide sufficient compression strength to prevent any deformation or collapse of the container when others are stacked upon it.

Multi-layered containers are conventionally manufactured with corrugated paperboard having vertically aligned corrugations. The purpose of this vertical alignment is two-fold. First, vertical alignment of the corrugations makes it easier to fold the container about a vertical line and thus form the corners. Second, vertical alignment of the corrugations increases the compression or stacking strength of the container. There are problems, however, with using paperboard having vertically aligned corrugations. The primary problem is that the alignment of the corrugations renders the side walls more likely to crease or take a "false score." A related problem is that a container formed with vertically aligned corrugated paperboard is more likely to experience side wall bulge.

Yet another prior art attempt to improve both stacking strength and bulge resistance has been to insert posts into the corners of the container. These posts are often formed of laminated paperboard, wood, or some like rigid material. While corner posts are recognized to improve stacking strength in unit load containers—containers for appliances, machinery, etc.—, they are ineffective when used in a bulk material container for many reasons. One reason is that the bulk material is often surrounded in the container by a bag or sack made of polyurethane. As the bulk material flows within the container, the posts are dislodged and will tear the polyurethane bag. In addition, because the bulk material will settle into the corners of the container while being packed, the very insertion of any corner post can tear the polyurethane bag. Yet further, movement of the bulk material upon shipment of the container can break or splinter a corner post. Once the bag is torn, the posts can and often do contaminate the bulk materials stored therein.

Yet other problems exist when corner posts are used. The posts, by their very presence, decrease the usable volume of space within the container. Because the corner posts are placed directly in the corner, it is not possible to collapse or "knock down" containers with corner posts. It is desirable, and in light of the costs associated with shipping containers from the manufacturer to an end user, necessary that a bulk material container be knocked down for delivery to a customer. When inserted posts are used, they must be shipped separately of the container so that the container can be knocked down for shipping. Thus, the corner posts cannot be pre-attached to the container by the manufacturer. As a result, an additional unnecessary set-up cost is incurred by the end user. Furthermore, an additional cost is recognized in the shipment and maintenance of an additional inventory of posts separate and apart from the containers themselves. All of these factors work to increase the cost of the end product in terms of labor, handling, materials, and time. These factors further work to increase the cost of purchasing the containers as the customer must coordinate the purchasing, storing, and matching of containers and corner posts.

Thus, the prior art has heretofore lacked a bulk material container having sufficient side wall rigidity in both the horizontal and vertical planes to provide a container with the desired bulge resistance and compression strength. The prior art has further lacked an integral container of side wall rigidity that could be knocked down flat for shipment by the manufacturer and easily set up by the end user.

Relatively large, heavy duty shipping containers are commonly reused by returning the empty container after removal of the items shipped within the container. Since empty or full shipping containers occupy the same volume, returning an empty container requires just as much shipping space as the container required in the first instance. Since the expenses for shipping or storage may be determined by volume, reusing empty containers is relatively expensive. Frequently, it is not economically feasible to reuse empty containers because of the shipping expense.

Thus, various systems have been used to reduce the cost of shipping and storing empty containers in a knock-down condition. But, such systems ordinarily require considerable labor and frequently require relatively expensive container construction. Thus, there has been a need for shipping containers that can be stored or shipped in knock-down condition, that can be disassembled and reassembled swiftly without any substantial manual effort or labor or tools, and that are of sufficiently heavy duty construction to satisfy the initial shipping requirements.

It is desirable for reasons of economy and conservation to be able to reuse large, relatively expensive bulk shipping containers. Moreover, some companies require the use of reusable containers by suppliers in order to reduce cost and also to avoid the problems of disposing of conventional shipping containers designed for single use.

Most shipping containers are made from corrugated paper board or cardboard that is not sufficiently strong or weather resistant to render it practical for reuse, especially in the case of large containers designed to contain heavyweight materials and requiring mechanical lifting assistance, such as by use of supporting wooden pallets and fork-lifting equipment.

Some shipping containers are made from wood, which may be durable and weather resistant. These containers, however, are bulky and heavy, so as to be expensive to ship back to the supplier. Also, wooden containers generally are nailed together and therefore may be difficult to open without damaging the wood and destroying the reusability of the container. Also, wood is relatively brittle and susceptible to cracking during shipment, lifting, discharge of contents, etc.

It is known to use rigid metal and plastic shipping containers that avoid many of the difficulties inherent in the use of other construction materials, such as cardboard and wood. The main problem with these shipping containers is their bulk that presents an expense and a storage problem for both the customer and the supplier. Empty rigid shipping containers require as much room as filled containers during storage and also during shipping.

A shipping container or bin containing fruit, vegetables, goods, parts, or other useable products is often accessed by collapsing a wall of the container or bin to make the contents available. Often the contents are directly displayed and dispensed from the container in this manner. One way of collapsing the wall of the container or bin, particularly a fiberboard container or bin, is by using a mat knife or the like to cut the corners of the container to collapse the wall. This method, while gaining ready access to the contents, is wasteful in that the containers are not reusable after their corners are cut unless such cutting is precise and the sides are taped for reuse. In the latter instance, the taped corners are weakened corners. Consequently, containers with taped corners are usually not reusable. Moreover, as the containers are shipped or stored, one on top of another, there is often a breakdown of the sides of the containers so that if they may be used again, their useful life is often only one or two cycles.

Cartons for packaging agricultural products, electric appliances, or other solid objects are often partially assembled in the manufacturing factory. The bottom and top flaps are left unstapled and untaped so that the cartons may lay flat to exhibit their two-dimensional configuration for the ease of carrying and shipping. A carton can be extended to hold solid objects by stapling or taping the bottom flaps. When the carton is not in use, the staples or adhesive tapes used to join the bottom flaps are then removed in order to flatten the carton so as to minimize the space occupied by the empty carton. In the process of removing the staples and adhesive tapes, however, the surface of the carton may be blemished or the carton itself may be damaged. Many users would hence rather discard used cartons than keep them for re-use.

It is therefore desirable to provide a folding box structure to overcome the aforementioned problems and thus to prolong the use of boxes.

Containers are the predominant way of shipping various goods, including materials in a liquid, semi-liquid, or powder form. It has been discovered that containers made of several laminated fiber layers are particularly useful for this purpose because they are relatively light, yet strong enough to hold various kinds of materials securely. Moreover, several such containers can be stacked vertically. In particular, fiber drums having substantially rectangular cross-sections with rounded corners have been found to be very advantageous because this shape makes the containers very strong. A further advantage of these containers is that their tops can be easily stored therein without distortion, while the containers are not in use.

One problem with the containers presently used in the industry is that when they are empty they occupy a large amount of space, they are difficult to handle, and expensive to ship. Although metal drums and other types of containers are known, which can be disassembled, so far no collapsible fiber containers have been suggested in the art that have proved to be satisfactory.

Numerous innovations for containers have been provided in the prior art that will be described below. Even though these innovations may be suitable for the specific individual purposes to which they address, they each differ in structure and/or operation and/or purpose from the present invention.

(1) U.S. Pat. No. 641,207 to Higham.

U.S. Pat. No. 641,207 issued to Higham on Jan. 9, 1900 teaches a packaging-box of two independent sections. One section is adapted to be folded and secured together to form a quadrangular box having open ends. The other section is adapted to be folded so as to form the ends of the same. A strip is secured to the inner surfaces of one side of the box-section. Tongues are carried by the other section and are adapted to be forced between the strip and the side of the box-section.

(2) U.S. Pat. No. 2,003,326 to Wellman.

U.S. Pat. No. 2,003,326 issued to Wellman on Jun. 4, 1935 teaches a knockdown container including a telescoping tubular body and end closure portions. Each end closure portion includes an end wall and surrounding walls. Tab projections are arranged in wedge formation and fixed to certain of the end walls. Free end tongues project from the body and are adapted to interlock with the tab projections and retain the body and closure portions in assembled set up relationship.

(3) U.S. Pat. No. 2,019,787 to Leopold.

U.S. Pat. No. 2,019,787 issued to Leopold on Nov. 5, 1935 teaches a container including an outer body section, a polygonal bottom section connected to the outer body section along opposite parallel edges and having free flap portions adapted to lie 9 adjacent the body portion. The bottom section has a diametric score line parallel to the opposite edges. An inner body section has inwardly extending flaps connected thereto and an oversize inner bottom section positioned adjacent the flaps and pressed into engagement with the inner body section.

(4) U.S. Pat. No. 2,132,666 to Williams.

U.S. Pat. No. 2,132,666 issued to Williams on Oct. 11, 1938 teaches a multi-sided container including a body member having a multiplicity of longitudinal creases dividing the body into panels, and a collar mounted on the end of the body. The collar has panels corresponding to the body panels. A polygonal closure sheet has tabs projecting from the sides thereof and inserted between panels of the body member and the collar. The collar has flaps folded over against the closure sheet substantially covering it.

(5) U.S. Pat. No. 2,775,393 to Rugg.

U.S. Pat. No. 2,775,393 issued to Rugg on Dec. 25, 1956 teaches a collapsible wall assembly for boxes, including a plurality of side walls disposed in rectangular relation. The side walls have hinged corner connections to provide a structure having oppositely disposed open ends. Two of the side walls are disposed in opposed relation including separate panels. Each panel has adjacent edge portions extending substantially parallel to the corner connections. A hinge member connects the adjacent edge portions of the panels of each side wall, whereby the panels may be hingedly moved inwardly for collapsing the structure. Corner supports for the structure include triangular-shaped tubular members disposed in the corners of the structure and coextensive with the side walls. Each of the tubular members has a first wall connected to a panel and a second wall connected to an adjacent side wall. The first and second walls of the tubular members are hingedly connected. Each of the tubular members further has a third wall including wall sections hingedly connected to the first and second walls. The sections have inner surfaces disposed within the tubular members. Apparatus hingedly connects the sections together. All of the hinged connections are substantially parallel to each other, whereby the corner supports may be positioned in flat collapsed relation with the inner surfaces of the sections in contiguous contacxt during collapse of the structure.

(6) U.S. Pat. No. 3,937,392 to Swisher.

U.S. Pat. No. 3,937,392 issued to Swisher on Feb. 10, 1976 teaches a knock-down, collapsible drum container assembly, including a pair of polygonal tubular members. One member is adapted to fit within the other and includes outer and inner tubular members of the container. Each of the members is collapsible to a substantially flat state along oppositely disposed, axially extending score lines thereof. End closures for the tubular members include pairs of inner and outer closure caps. The inner closure caps are configured to fit within the outer tubular member at the opposite ends thereof and have integral therewith radially extending flaps bendable along score lines to bear against the inner wall of the outer tubular member. The inner tubular member is configured to fit within and bear against the flaps as so disposed. The outer closure caps are configured to span the ends of the outer tubular member and have integral therewith radially extending flaps bendable along score lines into engagement with the outer wall of the outer tubular member, whereby the flaps may be clamped against the outer wall by clamping rings bearing thereagainst. The outer tubular member has preferably collared terminations at its opposite ends and the flaps of the outer caps are notched for seating the clamping rings at points above the collared terminations for locking engagement therewith by the clamping rings. The tubular members are preferably formed of substantially rectangular sheets of flexible material transversely scored at spaced intervals with opposite ends of the sheets joined to form the tubes.

(7) U.S. Pat. No. 4,635,815 to Grigsby.

U.S. Pat. No. 4,635,815 issued to Grigsby on Jan. 13, 1987 teaches a reinforced container for bulk pack materials. A first blank of paperboard is bonded to a second blank of paperboard. A plurality of support members are fixedly secured between the first blank and second blank of paperboard so as to reinforce the container. The support members are preferably formed of wood and positioned near the corners of the container.

(8) U.S. Pat. No. 4,673,087 to Webb.

U.S. Pat. No. 4,673,087 issued to Webb on Jun. 16, 1987 teaches a container formed of a rigid, flat base, a rigid cover, and four vertically arranged, flat wall forming panels being connected together along their adjacent vertical edges by hinge-like corner connectors and whose upper and lower edges are removably held in corresponding grooves formed in the base and cover. The panels are made of plastic extruded into parallel, spaced apart rigid sheets being interconnected by numerous, spaced apart, transverse strips whose opposite ends are integral with the sheets. Each corner has a flat, sheet-like base strip being integrally formed with a flexible center and rigid opposite edge sections extending along the length of the connector base. Each of the opposite edge sections has an integral T-shaped rib extending along its length. The ribs are inserted endwise into elongated vertical slots formed in the endmost strips of the adjacent panel edges for fastening the connectors to the panels. Additional hinge joints may be formed on the vertical center lines of two opposed panels so that these panels may be folded together for folding the wall panels flat for positioning within the base and encapsulated by the cover for non-use, storage, and shipping.

(9) U.S. Pat. No. 4,828,132 to Francis Jr. et al.

U.S. Pat. No. 4,828,132 issued to Francis Jr. et al. on May 9, 1989 teaches a reusable, collapsible, rectangular hinged container, including a foldable wall section or sleeve having strong, rigid weather-resistant wall panels and a pair of strong rigid, weather resistant top and bottom cap members. Each of the cap members overlaps with and supports a marginal area of the open wall section or sleeve to form the container. The wall section or sleeve contains a plurality of strong, rigid, panel-supporting hinge members enabling the sleeve to be folded to a flat condition in which it is completely receivable within and between the cap members to provide a compacted container to be returned to a supplier for reuse.

(10) U.S. Pat. No. 5,377,857 to Taravella et al.

U.S. Pat. No. 5,377,857 issued to Taravella et al. on Jan. 3, 1995 teaches a collapsible bin having corner constructions providing reinforcement at the corners thereof and joins the walls of the bin in a box configuration that may be collapsed. The collapsible corner construction includes a pair of casements joined together by an anchor pin. The anchor pin is received in T-slots within each of the casements. The anchor pin may be slipped or removed from the T-slots to release the casements from their joined condition, so that the walls of the container may be collapsed. An interlocking tab and slot configuration provides interlocking apparatus for stacking one collapsible bin upon another.

(11) U.S. Pat. No. 5,690,274 to Yang.

U.S. Pat. No. 5,690,274 issued to Yang on Nov. 25, 1997 teaches a folding box structure, and in particular, to a folding box structure in which a box includes two identical components. Each of the components includes a back panel being adjacent above to a lid panel and below to a bottom panel. The back panel adjoins on its two sides respectively an adhesive flap and a side panel. A trapezoidal-like recess is formed on the bottom panel along the outer edge. A crease is formed across from the joint of the bottom panel and the bottom side panel to the nearest vertex of the recess. Perforation is also provided along the crease for the ease of bending. These two components are engaged with each other by affixing the overlapping portions and by fitting together projections and recesses to form a box. A folding box in this structure can easily be folded and extended without further adhesion.

(12) U.S. Pat. No. 5,743,422 to Hale.

U.S. Pat. No. 5,743,422 issued to Hale on Apr. 28, 1998 teaches a collapsible, fiber, bulk container being made-up of a plurality of sidewalls joined by connectors to form a tubular body. The body is closed off by top and bottom members telescopically engaging the body. The bottom may be reinforced by a strut member to insure that the bottom does not warp and collapse. A reinforcing strap is also secured around the body.

(13) U.S. Pat. No. 6,241,148 to Schwimmer.

U.S. Pat. No. 6,241,148 issued to Schwimmer on Jun. 5, 2001 teaches a polygon-shaped container, including a plurality of normally rigid boards providing sides of a polygon-shaped container having a predetermined polygon configuration. Each of a plurality of connecting members connect adjacent edges of the plurality of normally rigid boards together. Each of the plurality of connecting members has sufficient strength to maintain the polygon-shaped container in the predetermined polygon configuration and yet sufficiently flexible to enable the plurality of normally rigid boards to be shipped flat to a user who will form the polygon-shaped container into the predetermined polygon configuration. A first arrangement closes a bottom of the polygon-shaped container. A second arrangement closes a top of the polygon-shaped container after being filled.

It is apparent that numerous innovations for containers have been provided in the prior art that are adapted to be used. Furthermore, even though these innovations may be suitable for the specific individual purposes to which they address, they would not be suitable for the purposes of the present invention as heretofore described.

3. SUMMARY OF THE INVENTION

Thus, an object of the present invention is to provide a polygon-shaped, knockdown, and stackable container that avoids the disadvantages of the prior art.

Briefly stated, another object of the present invention is to provide a polygon-shaped, knockdown, and stackable container. The container includes a side wall having a plurality of panels. The plurality of panels include a pair of skins and a plurality of cores. The plurality of cores are sandwiched between the pair of skins to form a laminate. The core has an axial compression strength greater than that of the pair of skins to allow the core to prevent puncturing, to provide insulation, to prevent any deformation or collapse during stacking, to avoid warping, and to resist against bulging as a result of internal material flow, while the pair of skins reduce overall weight.

The novel features being considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

4. BRIEF DESCRIPTION OF THE DRAWING

The figures of the drawing are briefly described as follows.

5. LIST OF REFERENCE NUMERALS UTILIZED IN THE DRAWING

Figure 1:
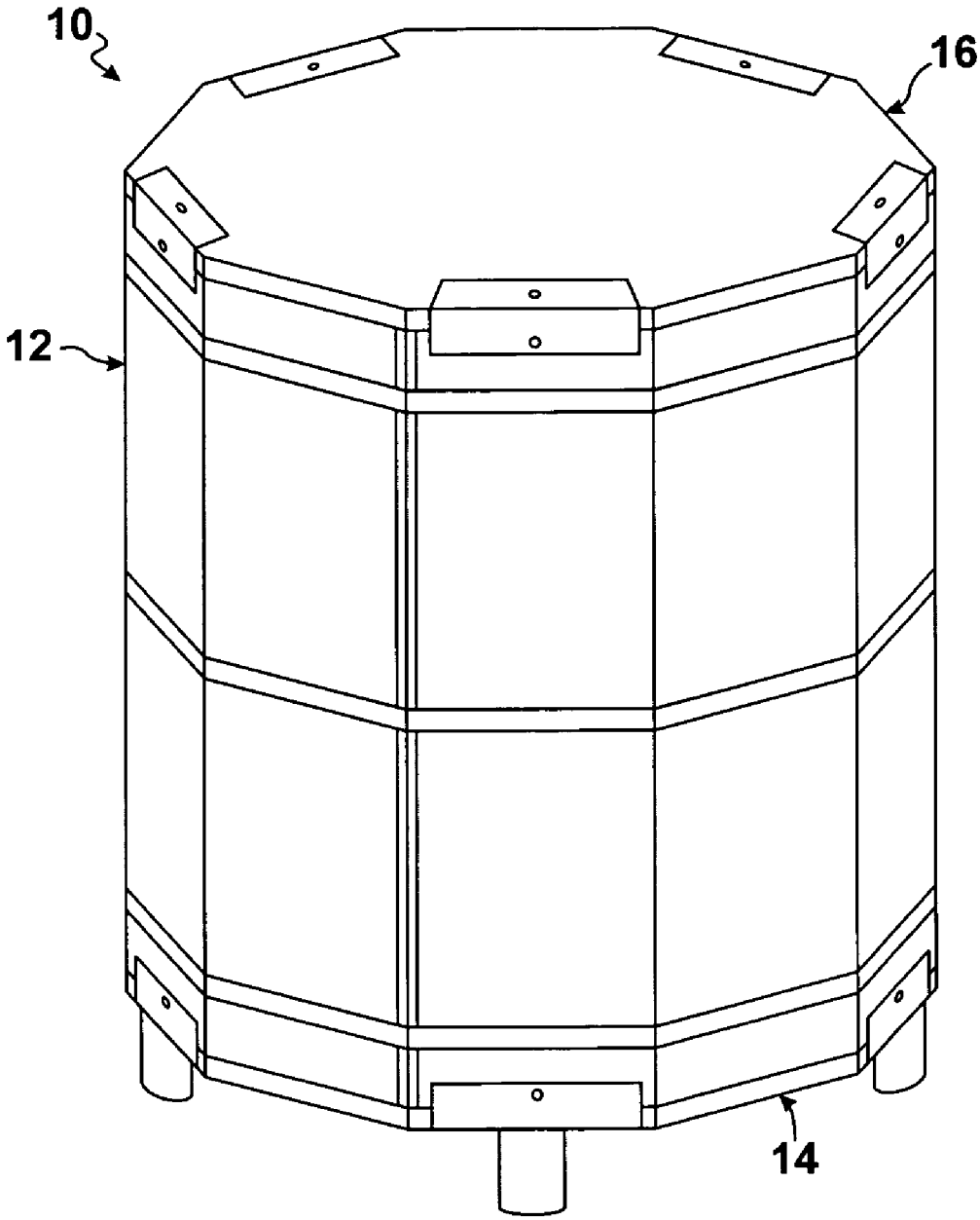
FIG. 1 is a diagrammatic perspective view of the polygon-shaped, knockdown, and stackable container of the present invention assembled.

10 polygon-shaped, knockdown, and stackable container of present invention
12 side wall
14 pallet
16 cover
18 plurality of side walls of side wall 12
20 plurality of connecting members of plurality of side walls 18 of side wall 12
22 polygon-shaped side wall of plurality of side walls 18 of side wall 12
24 lower attaching brackets
26 upper attaching brackets
28 plurality of panels of each side wall of plurality of side walls 18 of side wall 12
30 lower T-nut of each lower attaching bracket of lower attaching brackets 24
32 lower angle iron of each lower attaching bracket of lower attaching brackets 24
34 transverse portion of lower angle iron 32 of each lower attaching bracket of lower attaching brackets 24
36 upright portion of lower angle iron 32 of each lower attaching bracket of lower attaching brackets 24
38 first lower screw of each lower attaching bracket of lower attaching brackets 24
40 lower bolt of each lower attaching bracket of lower attaching brackets 24
42 feet of pallet 14
44 lower screws of feet 42 of pallet 14
46 upper T-nut of each upper attaching bracket of upper attaching brackets 26
48 upper angle iron of each upper attaching bracket of upper attaching brackets 26
50 transverse portion of upper angle iron 48 of each upper attaching bracket of upper attaching brackets 26
52 upright portion of upper angle iron 48 of each upper attaching bracket of upper attaching brackets 26
54 first upper screw of each upper attaching bracket of upper attaching brackets 26
56 upper bolt of each upper attaching bracket of upper attaching brackets 26
58 pair of skins of each side wall of plurality of side walls 18 of side wall 12
60 plurality of cores of each side wall of plurality of side walls 18 of side wall 12

62 plurality of score lines defining plurality of panels 28 of each side wall of plurality of side walls 18 of side wall 12

64 plurality of separate members of each core of plurality of cores 60 of each side wall of plurality of side walls 18 of side wall 12

66 pair of outer vertical members of plurality of separate members 64 of each core of plurality of cores 60 of each side wall of plurality of side walls 18 of side wall 12

68 pair of outer horizontal members of plurality of separate members 64 of each core of plurality of cores 60 of each side wall of plurality of side walls 18 of side wall 12

70 pair of inner vertical members of plurality of separate members 64 of each core of plurality of cores 60 of each side wall of plurality of side walls 18 of side wall 12

72 inner horizontal member of plurality of separate members 64 of each core of plurality of cores 60 of each side wall of plurality of side walls 18 of side wall 12

6. DETAILED DESCRIPTION OF THE PREFERRED EMBODIMENT

A. General

Referring now to the figures, in which like numerals indicate like parts, and particularly to FIG. 1, which is a diagrammatic perspective view of the polygon-shaped, knockdown, and stackable container of the present invention assembled, the polygon-shaped, knockdown, and stackable container of the present invention is shown generally at 10.

The polygon-shaped, knockdown, and stackable container 10 comprises a side wall 12, a pallet 14, and a cover 16. The side wall 12 is replaceably attached to the pallet 14. The cover 16 is replaceably attached to the side wall 12 to close the polygon-shaped, knockdown, and stackable container 10 after being filled.

B. Specific

The specific configuration of the polygon-shaped, knockdown, and stackable container 10 can best be seen in FIG. 2, which is a reduced exploded perspective view of the polygon-shaped, knockdown, and stackable container of the present invention shown in FIG. 1, and as such, will be discussed with reference thereto.

The side wall 12 comprises a plurality of side walls 18. The plurality of side walls 18 are normally rigid boards, generally rectangular, separate and distinct from each other, and are replaceably attached to each other—edge-to-edge—by a plurality of connecting members 20, respectively, using rivets or similar fasteners, such as staples—as taught by my U.S. Pat. No. 6,241,148 incorporated herein by reference thereto—to form a closed polygon-shaped side wall 22, and maintained thereat by, preferably circumferential strapping, such as plastic, metal, etc. The plurality of connecting members 20 are preferably plastic, flexible, and have sufficient strength to maintain the polygon-shaped, knockdown, and stackable container 10 in its predetermined polygon configuration and yet sufficiently flexible to enable the plurality of side walls 18 to be shipped flat to a user who forms the polygon-shaped, knockdown, and stackable container 10 into the predetermined polygon configuration without weakening the polygon-shaped, knockdown, and stackable container 10.

The pallet 14 is normally rigid and polygon-shaped to match that of the closed polygon-shaped side wall 22 to allow the closed polygon-shaped side wall 22 to be replaceably attached to the pallet 14 by lower attaching brackets 24.

The cover 16 is normally rigid and polygon-shaped to match that of the closed polygon-shaped side wall 22 to allow the closed polygon-shaped side wall 22 to be replaceably attached to the cover 16 by upper attaching brackets 26.

Each of the plurality of side walls 18 comprises a plurality of panels 28, preferably of equal width and height.

Each of the lower attaching brackets 24 comprises a lower T-nut 30 and a lower angle iron 32 having a transverse portion 34 and an upright portion 36.

The lower T-nut 30 is affixed to each of a respective number of the plurality of panels 28.

The transverse portion 34 of the lower angle iron 32 is affixed to the pallet 14 by a first lower screw 38.

The upright portion 36 of the lower angle iron 32 is replaceably affixed to each of a respective number of the plurality of panels 28 by a lower bolt 40 replaceably engaging the lower T-nut 30 of an associated lower attaching brackets 24.

The pallet 14 has feet 42. The feet 42 of the pallet 14 are affixed thereto by second lower screws 44.

Each of the upper attaching brackets 26 comprises an upper T-nut 46 and an upper angle iron 48 having a transverse portion 50 and an upright portion 52.

The upper T-nut 46 is affixed to each of a respective number of the plurality of panels 28.

The transverse portion 50 of the upper angle iron 48 is affixed to the cover 16 by a first upper screw 54.

The upright portion 52 of the upper angle iron 48 is replaceably affixed to each of the respective number of the plurality of panels 28 by an upper bolt 56 replaceably engaging the upper T-nut 46 of an associated upper attaching brackets 26.

C. Each Side Wall 18

Figure 2:
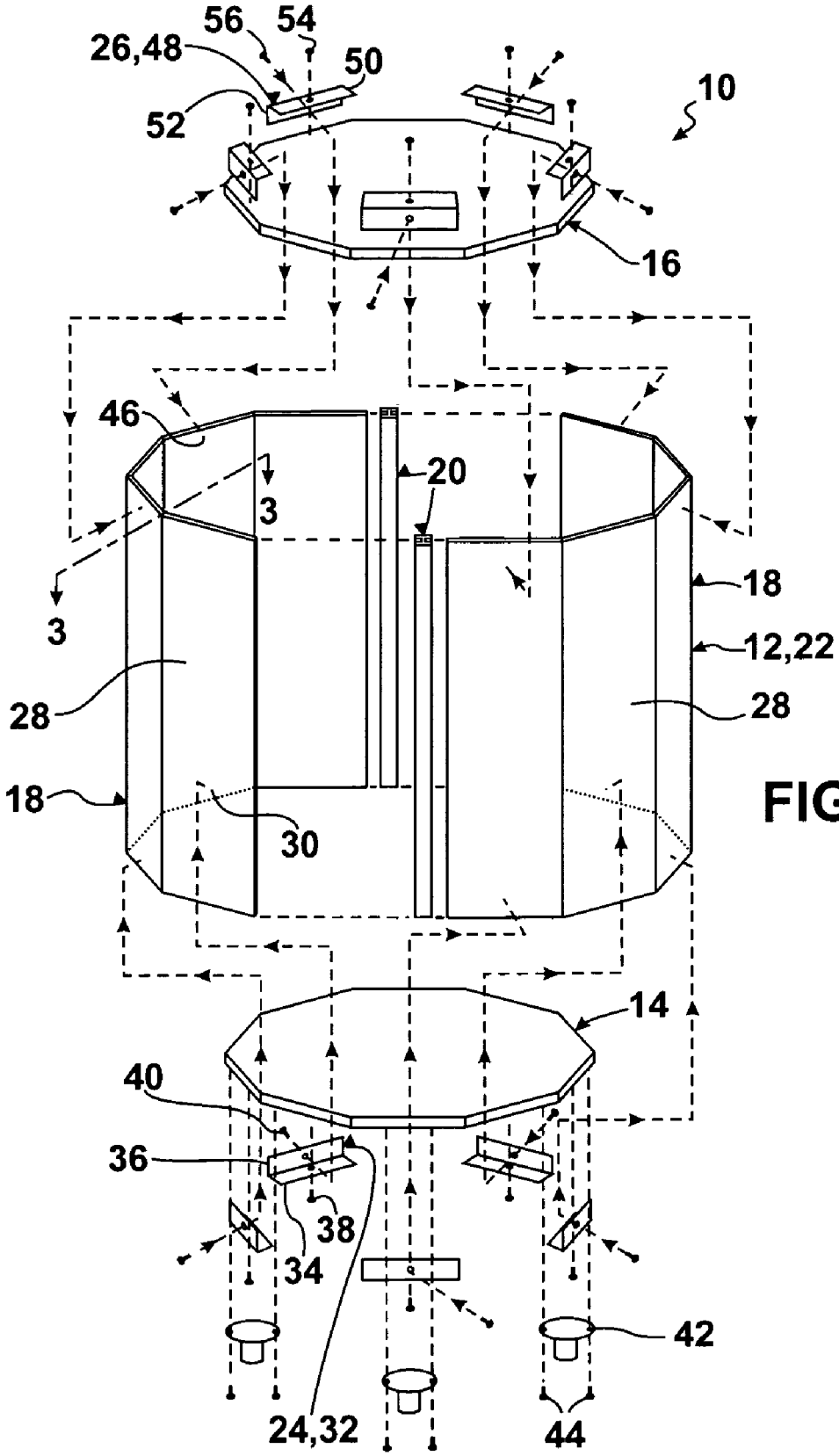
FIG. 2 is a reduced exploded perspective view of the polygon-shaped, knockdown, and stackable container of the present invention shown in FIG. 1.
Figure 3:
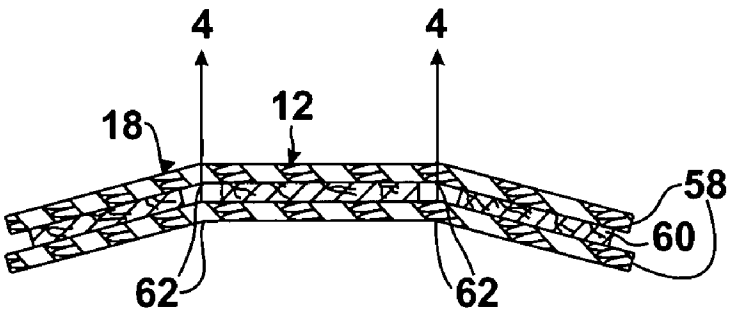
FIG. 3 is an enlarged diagrammatic cross sectional view taken along LINE 3-3 in FIG. 2 showing the laminated side walls.

The specific configuration of each side wall 18 can best be seen in FIGS. 3 and 4, which are, respectively, an enlarged diagrammatic cross sectional view taken along LINE 3-3 in FIG. 2 showing the laminated side walls, and an enlarged diagrammatic cross sectional view taken along LINE 4-4 in FIG. 3 showing the hardwood core of a panel of the laminated side walls, and as such, will be discussed with reference thereto.

Each of the plurality of side walls 18 is laminated and comprises a pair of skins 58 and a plurality of cores 60 sandwiched between the pair of skins 58.

The plurality of panels 28 are defined by a plurality of indentations 62—provided by a crease machine—into the pair of skins 58 to allow each of the plurality of side walls 18 to be bent into the plurality of panels 28.

The core 60 of each panel 28 occupies a space short of the plurality of indentations 62 defining an associated panel 28 to avoid interfering with the plurality of indentations 62 in the pair of skins 58 and allow the plurality of side walls 18 to be bent into a polygon shape to match that of the pallet 14 and the cover 16.

The core 60 of each panel 28 has an axial compression strength greater than that of the pair of skins 58 of each of the plurality of side walls 18 to allow the core 60 of each panel 28 to prevent puncturing, to provide insulation and sufficient compression strength to prevent any deformation or collapse during stacking up to 20,000 lbs., to avoid warping, and to resist against bulging as a result of internal material flow, while the pair of skins reduce overall weight.

The pair of skins 58 are made of Kraft liner boards, virgin liner boards, fiber boards, or preferably ten layers of laminated fiber boards, while the core 60 is made of hardwood.

Figure 4:
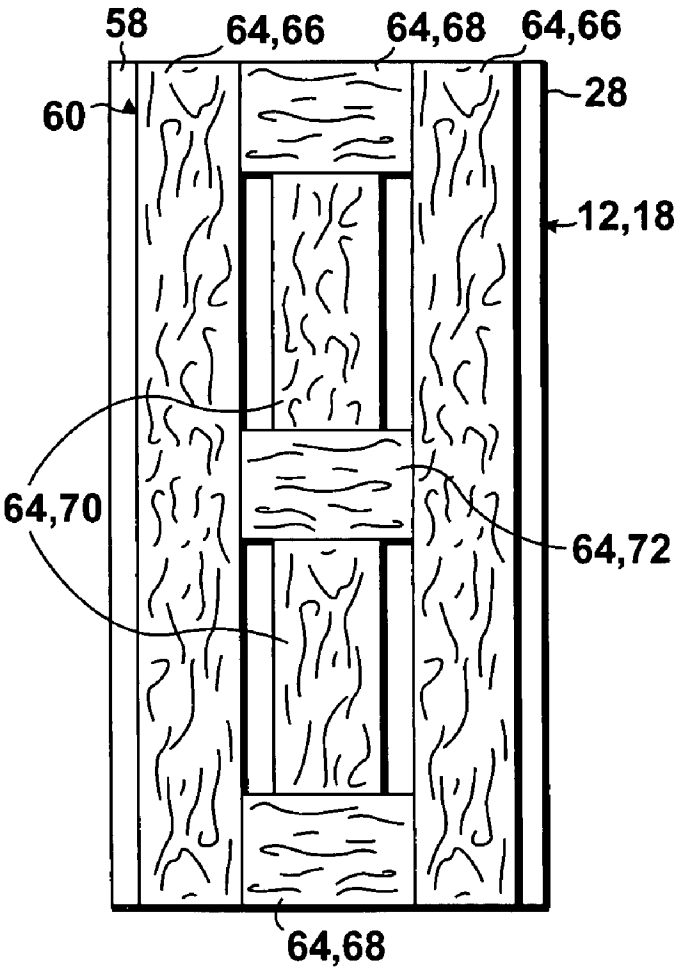
FIG. 4 is an enlarged diagrammatic cross sectional view taken along LINE 4-4 in FIG. 3 showing the hardwood core of a panel of the laminated side walls.

As shown in FIG. 4, in order to further reduce the weight, the core 60 is not solid and comprises a plurality of separate members 64.

The plurality of separate members 64 of the core 60 comprise a pair of outer vertical members 66, a pair of outer horizontal members 68, a pair of inner vertical members 70, and an inner horizontal member 72. The pair of outer vertical members 66 of the core 60 extend spaced inwardly of the plurality of indentations 62 defining an associated panel 28. The pair of outer horizontal members 68 of the core 60 extend along upper and lower extremes of the plurality of panels 28, from one outer vertical member 66 of the core 60 to the other outer vertical member 66 of the core 60. The inner horizontal member 72 of the core 60 extends intermediate the pair of outer horizontal members 68 of the core 60, from one outer vertical member 66 of the core 60 to the other outer vertical member 66 of the core 60. The pair of inner vertical members 70 of the core 60 are spaced inwardly of and between the pair of outer vertical members 66 of the core 60, with one vertical inner member 70 of the core 60 extending from one outer horizontal member 68 of the core 60 to the inner horizontal member 72 of the core 60, and with the other vertical inner member 70 of the core 60 extending from the other outer horizontal members 68 of the core 60 to the inner horizontal member 72 of the core 60.

The pair of outer horizontal members 68 of the core 60 receive the lower T-nut 30 of each of the lower attaching brackets 24 and the upper T-nut 46 of each of the upper attaching brackets 26, respectively.

When the plurality of side walls 18 are bent into shape, the plurality of connecting members 20 are pushed onto adjacent ends of the plurality of connecting members 20, which are stapled or riveted or otherwise fastened from the top to the bottom so that the plurality of side walls 18 are attached to each other as one piece to allow the polygon-shaped, knockdown, and stackable container 10 to be shipped flat to a customer.

The polygon-shaped, knockdown, and stackable container 10 can be made from thick, light weight material, or by increasing the number of sheets laminated together to enable shipping very heavy material.

The polygon-shaped, knockdown, and stackable container 10 can be employed for packaging solid material. By employing an impervious liner disposed within the polygon-shaped, knockdown, and stackable container 10, a liquid can be packaged therein.

The impervious liner is a poly coated paper liner with the poly layer adjacent the liquid. The inside of the polygon-shaped, knockdown, and stackable container 10 is sprayed or otherwise coated with an adhesive to which the paper layer of the poly coated paper liner will adhere to keep the liner in place during transport, thereby preventing wear on the liner and preventing interfering with the emptying of the liquid.

The use of just a poly liner has disadvantages being detrimental to the transport and emptying of a liquid. There are no adhesives that can be used to hold a poly liner in place in the polygon-shaped, knockdown, and stackable container 10 without causing deterioration of the poly material, thereby causing leaks in the liner and the polygon-shaped, knockdown, and stackable container 10. Due to corners in the polygon-shaped, knockdown, and stackable container 10, the poly liner will experience wear during transport, which again results in leaks in the liner and the polygon-shaped, knockdown, and stackable container 10. Since the poly liner is not held in place, the liner will collapse during emptying of the liquid, which hinders emptying of the liquid.

D. Conclusions

It will be understood that each of the elements described above, or two or more together, may also find a useful application in other types of constructions differing from the types described above.

While the invention has been illustrated and described as embodied in a polygon-shaped, knockdown, and stackable container, however, it is not limited to the details shown, since it will be understood that various omissions, modifications, substitutions, and changes in the forms and details of the device illustrated and its operation can be made by those skilled in the art without departing in any way from the spirit of the present invention.

Without further analysis, the foregoing will so fully reveal the gist of the present invention that others can by applying current knowledge readily adapt it for various applications without omitting features that from the standpoint of prior art fairly constitute characteristics of the generic or specific aspects of the invention.

The invention claimed is:

1. A polygon-shaped, knockdown, and stackable container, comprising: a side wall; wherein said side wall comprises a plurality of panels; wherein said plurality of panels comprise a pair of skins; wherein said plurality of panels comprise a plurality of cores; wherein said plurality of cores of said plurality of panels are sandwiched between said pair of skins of said plurality of panels to form a laminate; and wherein said core has an axial compression strength greater than that of said pair of skins to allow said core to prevent puncturing, to provide insulation, to prevent any deformation or collapse during stacking, to avoid warping, and to resist against bulging as a result of internal material flow, while said pair of skins reduce overall weight; wherein said plurality of panels are defined by a plurality of indentations in said pair of skins so as to form living hinges that allow the side wall to be bent into said plurality of panels; wherein said core of each panel occupies a space short of said living hinges in said pair of skins to avoid interfering with said living hinges in said pair of skins and allow said plurality of panels to be bent into a polygon shape; wherein each core is made entirely of hardwood;

wherein each core is not solid and comprises a plurality of separate members to further reduce weight;

wherein said plurality of separate members of each core comprise a pair of outer vertical members; wherein said plurality of separate members of each core comprise a pair of outer horizontal members; wherein said plurality of separate members of each core comprise a pair of inner vertical members; and wherein said plurality of separate members of each core comprise an inner horizontal member;

wherein said pair of outer vertical members of each core are spaced inwardly of said plurality of indentations;

wherein said pair of outer horizontal members of each core extend along upper and lower extremes of said plurality of panels, from one outer vertical member of an associated core to the other outer vertical member of said associated core;

wherein said inner horizontal member of each core extends intermediate said pair of outer horizontal members of an associated core, from one outer vertical member of said associated core to said other outer vertical member of said associated core; and wherein said pair of inner vertical members of each core are spaced inwardly of and between said pair of outer vertical members of an associated core, with one inner vertical member of said associated core extending from one outer horizontal member of said associated core to said inner horizontal member of said associated core, and with the other inner vertical member of said associated core extending from the other outer horizontal member of said associated core to said inner horizontal member of said associated core.

2. The container of claim 1, further comprising a pallet; and wherein said side wall is replaceably attached to said pallet.

3. The container of claim 2, further comprising a cover; and wherein said cover is replaceably attached to said side wall to close the polygon-shaped, knockdown, and stackable container after being filled.

4. The container of claim 3, wherein said side wall comprises a plurality of side walls.

5. The container of claim 4, wherein said plurality of side walls are normally rigid boards; wherein said plurality of side walls are generally rectangular; wherein said plurality of side walls are separate and distinct from each other; and wherein said plurality of side walls are replaceably attached to each other, edge-to-edge, by a plurality of connecting members, respectively, to form a closed polygon-shaped side wall.

6. The container of claim 5, further comprising lower attaching brackets; wherein said pallet is normally rigid; and wherein said pallet is polygon-shaped to match that of said closed polygon-shaped side wall to allow said closed polygon-shaped side wall to be replaceably attached to said pallet by said lower attaching brackets.

7. The container of claim 5, further comprising upper attaching brackets; wherein said cover is normally rigid; and wherein said cover is polygon-shaped to match that of said closed polygon-shaped side wall to allow said closed polygon-shaped side wall to be replaceably attached to said cover by said upper attaching brackets.

8. The container of claim 4, wherein each side wall comprises said plurality of panels.

9. The container of claim 6, wherein each lower attaching bracket comprises a lower T-nut; wherein each lower attaching bracket comprises a lower angle iron; wherein said lower angle iron has a transverse portion; and wherein said lower angle iron has an upright portion.

10. The container of claim 9, wherein said lower T-nut is affixed to each of a respective number of said plurality of panels.

11. The container of claim 9, wherein said transverse portion of said lower angle iron is affixed to said pallet by a first lower screw.

12. The container of claim 9, wherein said upright portion of said lower angle iron is replaceably affixed to each of a respective number of said plurality of panels by a lower bolt replaceably engaging an associated lower T-nut.

13. The container of claim 2, wherein said pallet has feet; and wherein said feet of said pallet are affixed to said pallet by lower screws.

14. The container of claim 7, wherein each upper attaching bracket comprises an upper T-nut; wherein each upper attaching bracket comprises an upper angle iron; wherein said upper angle iron has a transverse portion; and wherein said upper angle iron has an upright portion.

15. The container of claim 14, wherein said upper T-nut is affixed to each of a respective number of panels.

16. The container of claim 14, wherein said transverse portion of said upper angle iron is affixed to said cover by a first upper screw.

17. The container of claim 14, wherein said upright portion of said upper angle iron is replaceably affixed to each of a respective number of said panels by an upper bolt replaceably engaging an associated upper T-nut.

18. The container of claim 1, wherein said pair of skins are made of a material selected from the group consisting of Kraft liner boards, virgin liner board, fiber boards, and laminated fiber boards.

19. The container of claim 1, wherein said pair of outer horizontal members of each core receive a lower T-nut and an upper T-nut, respectively.

20. The container of claim 1, further comprising a liquid-impervious liner; wherein said liquid-impervious liner lines said polygon-shaped, knockdown, and stackable container; and wherein said liquid-impervious liner is for packaging a liquid.

21. The container of claim 20, wherein said liquid-impervious liner is a poly coated paper liner; wherein said poly coated paper liner has a poly layer; wherein said poly coated paper liner has a paper layer; and wherein said poly liner is for facing the liquid.

22. The container of claim 21, further comprising an adhesive; wherein said side wall has an interior-facing surface; and wherein said interior-facing surface of said side wall is coated with said adhesive to adhere said paper layer of said poly coated paper liner thereto to keep said poly coated paper liner in place during transport, thereby preventing wear on said poly coated paper liner and to prevent interfering with emptying of the liquid.

* * * * *